US007588446B2

(12) United States Patent
Kobayashi

(10) Patent No.: US 7,588,446 B2
(45) Date of Patent: Sep. 15, 2009

(54) CONNECTOR AND A CONNECTOR ASSEMBLY

(75) Inventor: Yutaka Kobayashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/031,213

(22) Filed: Feb. 14, 2008

(65) Prior Publication Data

US 2008/0207024 A1 Aug. 28, 2008

(30) Foreign Application Priority Data

Feb. 26, 2007 (JP) ..... 2007-045263

(51) Int. Cl.
*H01R 13/44* (2006.01)

(52) U.S. Cl. ..... 439/135

(58) Field of Classification Search ..... 439/135, 439/144, 140, 157

See application file for complete search history.

(56) References Cited

U.S. PATENT DOCUMENTS 3,271,725 A * 9/1966 Bloch ..... 439/141
4,832,613 A * 5/1989 Tsukakoshi ..... 439/141
5,437,558 A * 8/1995 Sakuraoka et al. ..... 439/140
6,464,522 B2 * 10/2002 Osawa et al. ..... 439/271
6,623,285 B2 * 9/2003 Nishide ..... 439/140
6,692,274 B2 * 2/2004 Maegawa ..... 439/157
6,821,135 B1 * 11/2004 Martin ..... 439/144
2001/0039144 A1 11/2001 Osawa et al.
2003/0008537 A1 1/2003 Nishide
2003/0109167 A1 6/2003 Maegawa
2006/0154505 A1 7/2006 Nishide

* cited by examiner

*Primary Examiner*—Alexander Gilman
(74) *Attorney, Agent, or Firm*—Gerald E. Hespos; Anthony J. Casella

(57) ABSTRACT

A connector includes a receptacle (12) and a moving plate (40) that can move in the receptacle (12) as a female housing (60) is fit into receptacle (12). The moving plate (40) includes a main body (42) with positioning holes (47) for receiving tabs (17) of male terminal fittings (15). Leading ends of the tabs (17) project through the positioning holes (47) when the moving plate (40) is at an initial position. A protection wall (41) projects forward from the main body (42) and prevents a corner (66) of an improperly aligned female housing (30) from contacting the leading ends of the tabs (17) when the moving plate (40) is at the initial position. The female housing (60) has recesses (62) for receiving the protection wall (41) when the female housing (60) is aligned properly.

9 Claims, 6 Drawing Sheets

CONNECTOR AND A CONNECTOR ASSEMBLY

BACKGROUND OF THE INVENTION

1. Field of the Invention

The invention relates to a connector and to a connector assembly.

2. Description of the Related Art

U.S. Patent Application Publication No. 2006-0154505 discloses a connector with a male housing that has a forwardly open tubular receptacle and male terminal fittings that project into the receptacle. The connector also includes a female housing that can fit into the receptacle from the front. A moving plate is accommodated in the receptacle and is movable in forward and backward directions. The moving plate includes a plate-like main body formed with positioning holes. The leading ends of male terminal fittings are inserted through the positioning holes to project from the front surface of the main body before the male housing is connected with the female housing. An electrical connection test is performed at this initial position by pressing a probe pin against the leading ends of the male terminal fittings projecting from the front surface of the main body.

The leading ends of the male terminal fittings project from the front surface of the main body so that the electrical connection test can be performed. However, a corner of the female housing can contact and deform the leading ends of the male terminal fittings if the female housing is inserted into the receptacle in an improper or inclined posture.

The present invention was developed in view of the above situation, and an object thereof is to prevent male terminal fittings from being deformed in a connector provided with a moving plate.

SUMMARY OF THE INVENTION

The invention relates to a connector with a housing that includes a forwardly open receptacle for receiving a mating housing. At least one moving plate is provided for positioning terminal fittings in the receptacle. The moving plate includes a main body formed with positioning holes. The leading ends of the male terminal fittings project through the positioning holes and from the front surface of the main body when the moving plate is at an initial position. However, the moving plate is movable towards the back of the receptacle as the mating housing is fit into the receptacle. At least one protection wall projects from the front surface of the main body for protecting the leading ends of the terminal fittings projecting at the initial position. The protection wall is permitted to escape into a recess of the mating housing.

The mating housing may be inserted into the receptacle in an improper posture oblique to a fitting direction while the moving plate is accommodated at the initial position in the receptacle. However, the corner of the mating housing will contact with the projecting end of the protection wall to prevent damage or deformation of the terminal fittings.

The projecting end of the protection wall preferably is at least as far forward as the leading ends of the terminal fittings at the initial position.

The protection wall preferably includes at least two opposite walls arranged to extend substantially along two opposite sides of the main body.

A corner of the mating housing that is inserted into the receptacle in an improper posture preferably contacts the opposite walls while crossing over the terminal fittings between the opposite walls.

The protection wall preferably is arranged to surround a group of positioning holes. Thus, the main body is stronger and is not likely to be deformed plastically by external factors.

The connector preferably comprises a movable member that can be operated to perform or assist the connection of the housing with the mating housing. The moving plate preferably is displaced by the operation of the movable member.

The invention also relates to a connector assembly comprising the above described connector and a mating connector. The housing of the mating connector preferably is formed with a recess for receiving the protection wall.

These and other features of the invention will become more apparent upon reading the following detailed description and accompanying drawings.

DETAILED DESCRIPTION OF THE PREFERRED EMBODIMENTS

A connector assembly in accordance with the invention is illustrated in FIGS. 1 to 6. The connector assembly has a male housing 10 and a female housing 60 that are connectable with each other along connecting and separating directions CSD. Ends of the housings 10, 60 to be connected are referred to as the front ends in the following description.

Figure 1:
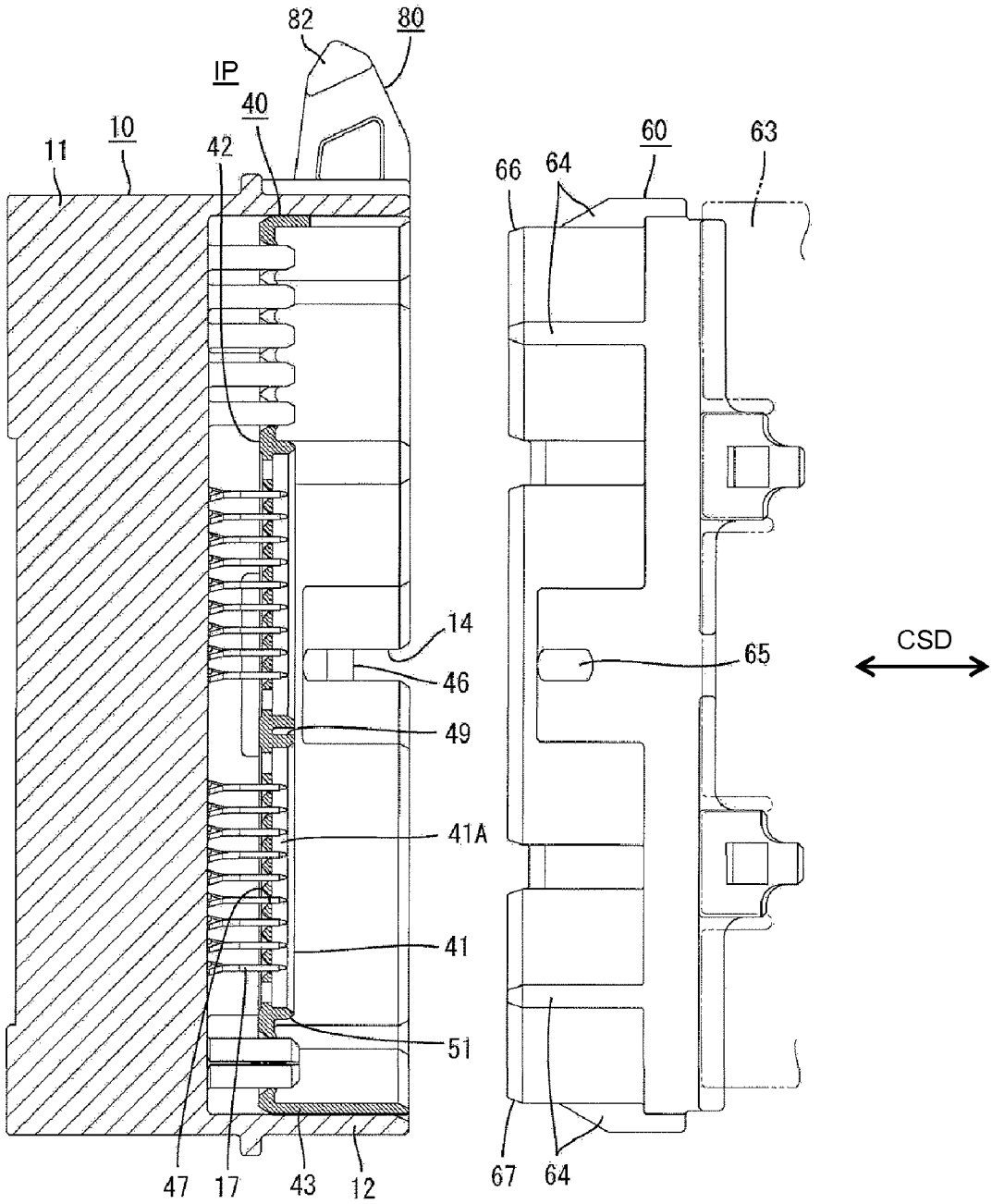
FIG. 1 is a side view in section showing a state before a connecting operation of two male and female housings is started in a first embodiment.
Figure 2:
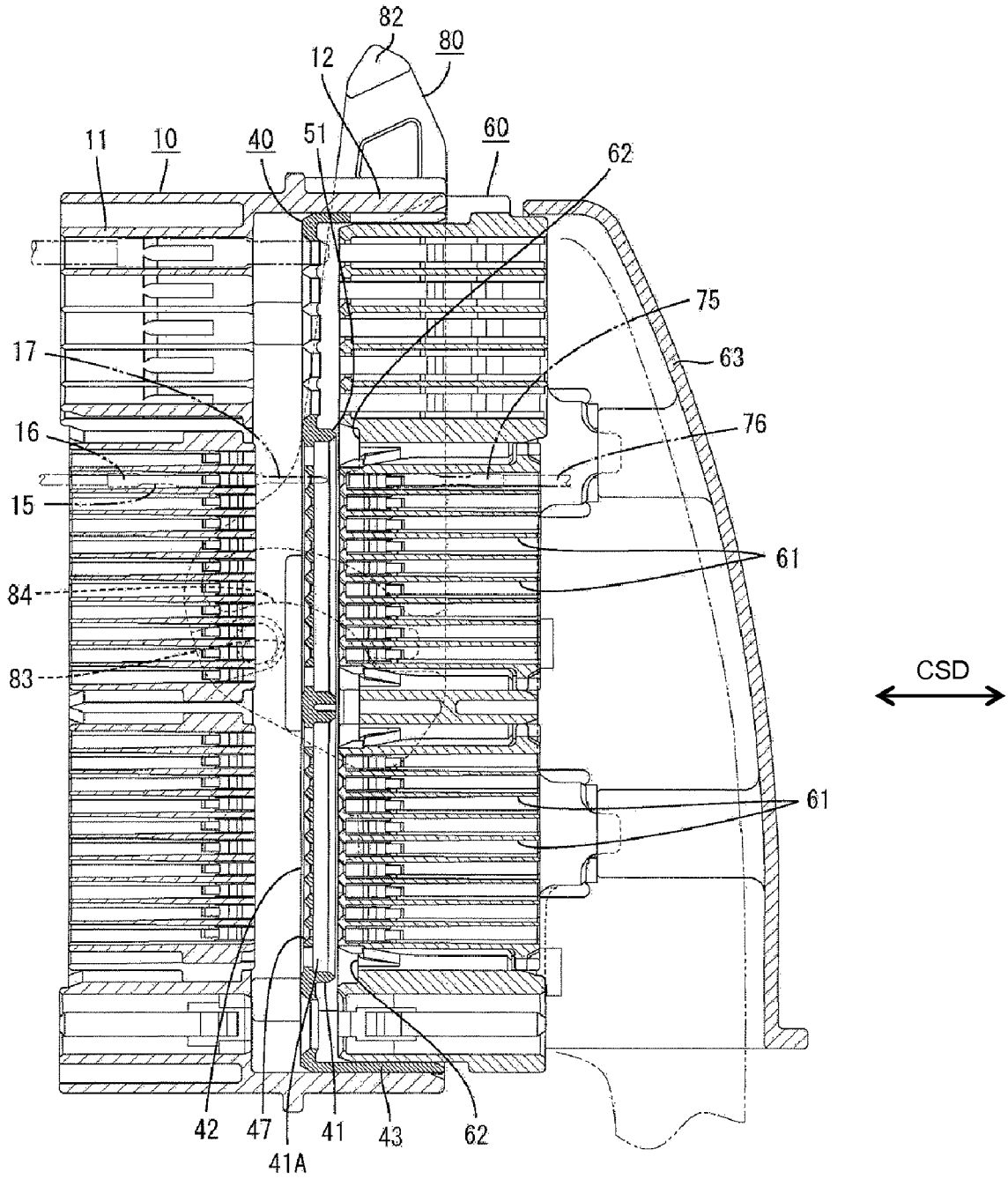
FIG. 2 is a side view in section showing a state where the connecting operation of the two housings is started.

The female housing 60 is made e.g. of synthetic resin and is substantially in the form of a block that is long and narrow in the vertical direction in FIG. 1. Cavities 61 are formed substantially side by side in the female housing 60 and are arranged at several stages in the height direction of the female housing 60 as shown in FIG. 2. The cavities 61 are configured for accommodating female terminal fittings 75. The front openings of the cavities 61 are aligned in the front surface of the female housing 60. Substantially U-shape recesses 62 are formed in the front surface of the housing 60 around groups of the cavities 61. The recesses 62 are retracted slightly from the front openings of the cavities 61.

A wire cover 63 is mounted on a rear part of the female housing 60, and draw-out directions of wires 76 connected with the female terminal fittings 75 are defined by the wire cover 63. Connection ribs 64 are formed on the outer surface of the female housing 60 and extend in forward and backward directions, as shown in FIG. 1. The connection ribs 64 guide a connecting operation of the two housings 10, 60 and prevent an erroneous connection of the two housings 10, 60. First cam pins 65 project in substantially middle parts of the opposite side surfaces of the female housing 60 and extend in substantially forward and backward directions. The first cam pins 65 have substantially oblong cross section.

The male housing 10 is made e.g. of a synthetic resin and includes a long narrow block shaped terminal holding portion 11 and a rectangular tubular receptacle 12 projects forward from a peripheral edge of the terminal holding portion 11. Male terminal fittings 15 are accommodated substantially side by side in the height direction in the terminal holding portion 11. The male terminal fittings 15 have main bodies 16 and long narrow tabs 17 that project unitarily forward from the terminal main bodies 16 into the receptacle 12. The tabs 17 are connectable with the corresponding female terminal fittings 75. Two supporting shafts 13 project in intermediate positions of the opposite side surfaces of the receptacle 12 in the height direction, and these side surfaces are cut straight from the front opening edge of the receptacle 12 towards the supporting shafts 13 to form two escape grooves 14. The first cam pins 65 enter the corresponding escape grooves 14 when connecting the housings 10, 60.

Figure 3:
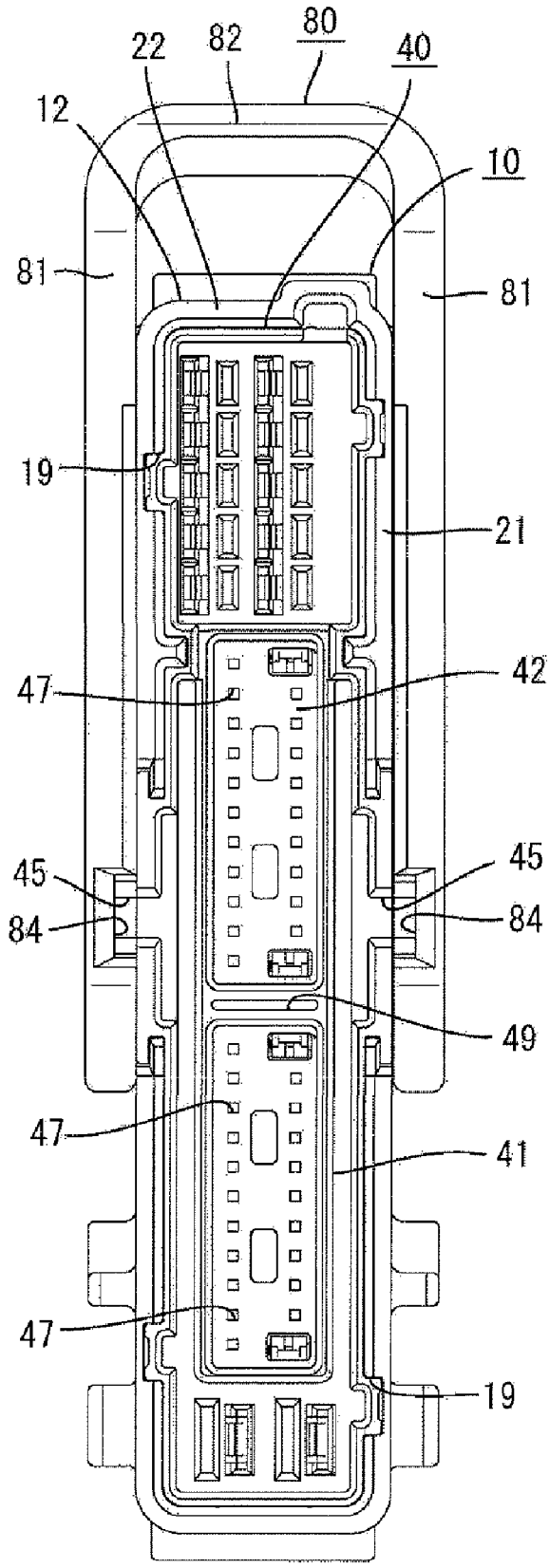
FIG. 3 is a front view of the female housing having a moving plate and a lever mounted.

The connector also includes a lever 80 made e.g. of synthetic resin. The lever 80 has left and right plate-like arms 81 and an operable portion 82 connecting the arms 81 to define a substantially U-shape, as shown in FIG. 3. Each arm 81 has a bearing hole 83 for receiving the corresponding supporting shaft 13 so that the lever 80 is rotatable about the supporting shafts 13 between a standby position and a connection position. The arms 81 stand up in the height direction when the lever 80 is in the standby position. However, the arms 81 cross the opposite outer side surfaces of the female housing 60 and the operable portion 82 is located behind the wire cover 63 when the lever 80 is in the connection position. An arcuate cam groove 84 is formed in the inner surface of each arm 81 and is substantially centered on the bearing hole 83. The cam groove 84 opens at the peripheral edge of the arm 81.

Figure 4:
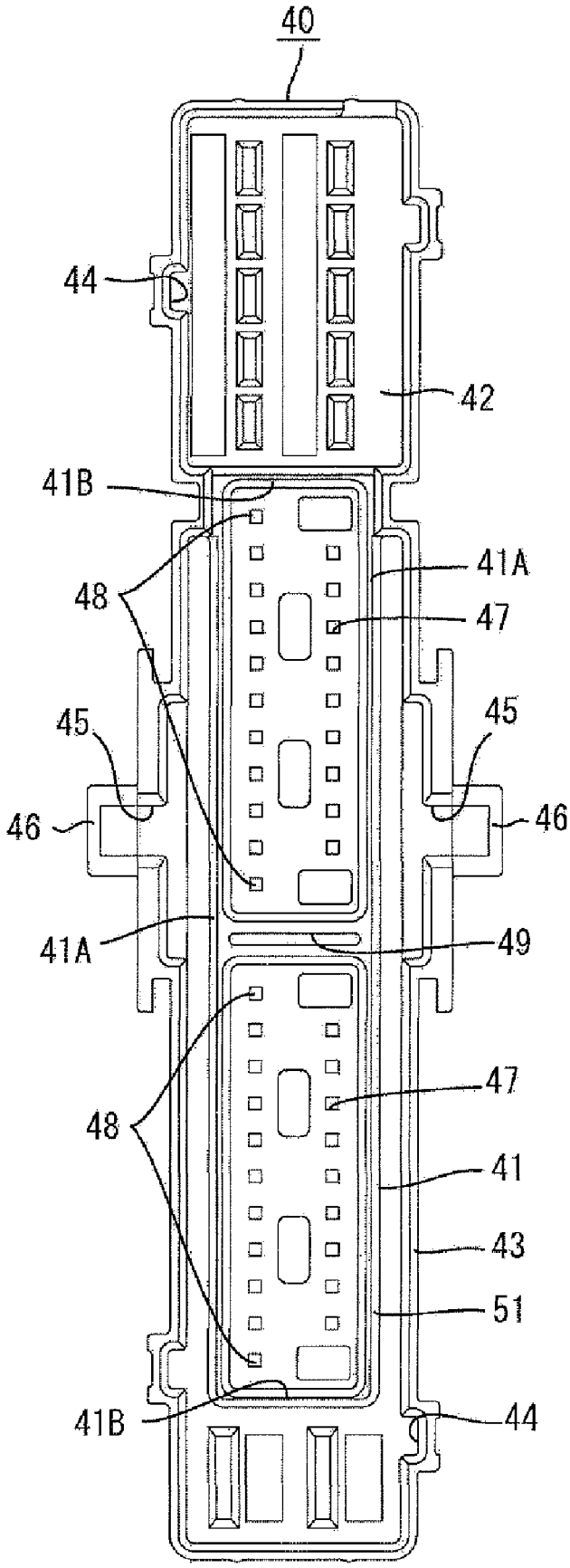
FIG. 4 is a front view of the moving plate.

The connector also includes a moving plate 50 made e.g. of synthetic resin and arranged in the receptacle 12 for positioning the tabs 17 in height and width directions. The moving plate 40 is movable forward and backward in the receptacle 12 substantially parallel to the connecting and separating directions CSD of the housings 10, 60. More particularly, the moving plate 50 includes a substantially rectangular plate-like main body 42 aligned substantially perpendicular to the moving direction of the moving plate 40 and a substantially rectangular tubular surrounding wall 43 that projects forward from the periphery of the main body 42. The outer peripheral surface of the surrounding wall 43 slides substantially in contact with the inner peripheral surface of the receptacle 12 upon connecting the two housings 10, 60. As shown in FIG. 4, receiving grooves 44 are formed in the inner surface of the surrounding wall 43 at positions corresponding to the connection ribs 64. Outer surfaces of the surrounding wall 43 bulge out at positions corresponding to the receiving grooves 44, and inner surfaces of the receptacle 12 are formed with recesses 19 for receiving the bulges of the surrounding wall 43.

Introducing grooves 45 extend in forward and backward directions in intermediate positions of the substantially opposite outer side surfaces of the surrounding wall 43 in height direction. The introducing grooves 45 open at the front edge of the surrounding wall 43 and are disposed and configured to receive the first cam pins 65. Second cam pins 46 project from the opposite outer side surfaces of the surrounding wall 43 and cross over the introducing grooves 45. The second cam pins 46 are substantially U-shaped when viewed from front, and the first cam pins 65 can fit therein. Thus, the second cam pins 46 can be fit into the cam grooves 84 of the lever 80 while being united with the first cam pins 65 until the two housings 10, 60 are connected completely. Thereafter, the female housing 60 and the moving plate 40 move together as the lever 80 is rotated.

Figure 5:
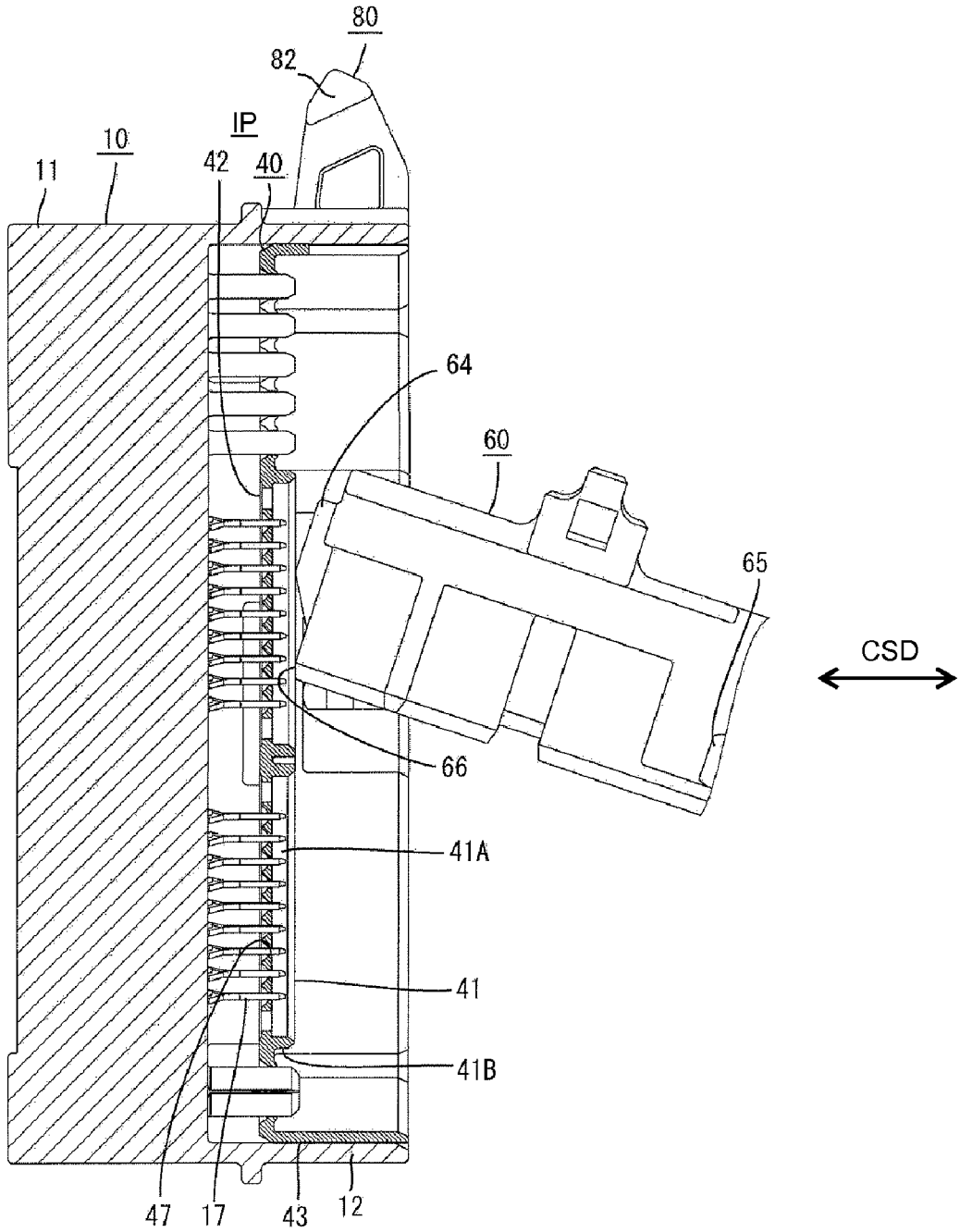
FIG. 5 is a side view in section showing a state where the female housing is inserted in an improper posture into a receptacle.

Positioning holes 47 penetrate the main body 42 at positions for receiving the tabs 17. More specifically, the positioning holes 47 are widened towards the rear surface of the main body 42 for guiding the insertion of the respective tabs 17 and are narrowed towards the front surface of the main body 42 for positioning the respective tabs 17. The moving plate 40 moves during the connection of the two housings 10, 60 from an initial position IP where the main body 42 is distanced from the back surface of the receptacle 12 to an end position at the end of the connecting operation where the main body 42 substantially contacts the back surface of the receptacle 12. The tabs 17 are kept in the positioning holes 47 at all position along a moving path of the moving plate 40 to position the tabs 17 reliably. Leading ends of the tabs 17 project from the front surface of the main body 42 and face towards a connection surface as shown in FIG. 5 when the moving plate 40 is at the initial position IP so that an electrical connection test may be conducted in this state. The leading ends of the tabs 17 are aligned at substantially the same position in the receptacle 12 in forward and backward directions.

The positioning holes 47 are divided into two equal groups 48 arranged in the height direction of FIGS. 3 and 4. A tab protection 41 is formed on the front surface of the main body 42 to face the female housing 60. The tab protection 41 includes two first protection walls 41A that extend in the height direction substantially parallel to the opposite longer side walls 21 of the receptacle 12. The first protection walls 41A are at positions laterally outward from the protection holes 47 and extend sufficiently far in the height direction to protect tabs 17 in all of the protection holes 47. The tab protection 41 also includes second protection walls 41 B that extend in the width direction and parallel to shorter side walls 22 of the receptacle 12. The second protection walls 41B are substantially normal to the first protection walls 41 a and are at positions above, below and between the two hole groups 48. The second protection wall 41B between the two hole groups 48 is formed with a slit 49 that extends in the width direction and has a depth from the projecting end of this second protection wall 41B to the front surface of the main body 42.

The tab protection 41 projects substantially straight forward a short distance with a specified thickness. The entire projecting end of the tab protection 41 is at substantially the same position in forward and backward directions, and chamfers 51 are defined at the inner and outer surfaces of the projecting end. The protection walls 41A and 41B of the tab protection 41 fit into the recesses 62 of the female housing 60 during connection of the housings 10, 60.

The projecting distance of the tabs 17 from the front surface of the main body 42 when the moving plate 40 is at the initial position IP is less than the projecting distance of the protection wall 41. Thus, the projecting ends of the tabs 17 are retracted back from the projecting ends of the protection walls 41A and 41B, as shown in FIG. 5. Conversely, the projecting end of the protection wall 41 is more forward than the projecting ends of the tabs 17 when the moving plate 40 is at the initial position IP.

The outer peripheral surface of the surrounding wall 43 is moved along the inner peripheral surface of the receptacle 12 to set the moving plate 40 at the initial position IP, as shown in FIG. 1, prior to connecting the male and female housings 10 and 60. Additionally, the lever 80 is held at the standby position. The female housing 60 then is inserted into the receptacle 12 along the connecting and separating directions CSD from the front. The front surface of the female housing 60 preferably is aligned normal to the connecting and separating directions CSD during this insertion. As a result, the female housing 60 fits into the moving plate 40 with the side surfaces of the female housing 60 surrounded by the surrounding wall 43 and with the front surface of the female housing 60 opposed to the front surface of the main body 42. In this state, the first cam pins 65 enter the cam grooves 84 of the lever 80 and fit into the introducing grooves 45. Thus, the first and second cam pins 65, 46 unite with each other engage with the cam grooves 84.

The lever 80 then is rotated towards the connection position, and a cam action of the second cam pins 46 and the cam grooves 84 moves the female housing 60 towards the back side of the receptacle 12. As a result, the two housings 10, 60 move closer together. At this time, the protection wall 41 of the main body 42 is fit into the recesses 62 of the female housing 60 and the moving plate 40 is positioned with respect to the female housing 60 to move parallel towards the back of the receptacle 12. The tabs 17 are kept in the respective positioning holes 47 while the moving plate 40 is moving and are held at substantially correct positions. Thus, the tabs 17 are inserted gradually into the female terminal fittings 75 from the leading ends thereof to increase a depth of connection with the female terminal fittings 75. The two housings 10, 60 are connected properly when the lever 80 reaches the connection position. At this time, the moving plate 40 reaches the end position and the tabs 17 are fit to proper depths in the female terminal fittings 75. As a result, the male and female terminal fittings 15, 75 are connected electrically.

Figure 6:
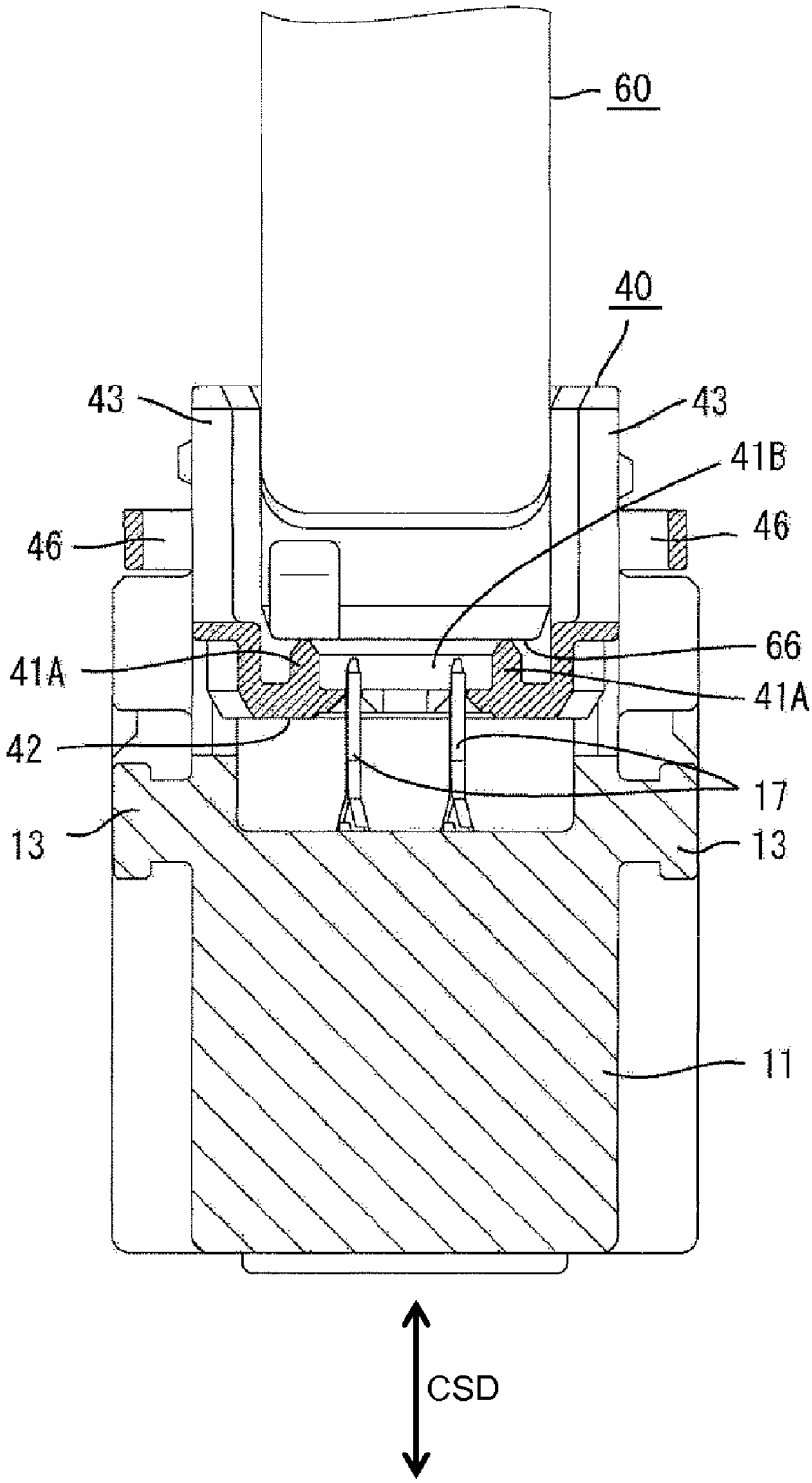
FIG. 6 is a horizontal section showing a state where the female housing is inserted in the improper posture into the receptacle.

The female housing 60 could be inserted into the receptacle 12 in an improper posture. For example, one of opposite end corners 66, 67 of the female housing 60 in the height direction could enter the receptacle 12 earlier than the other corner to incline the front surface of the female housing 60 with respect to the forward and backward directions. As a result, the leading corner 66 will contact the projecting ends of the first protection walls 41A of the tab protection 41, as shown in FIG. 5. At this time, the leading corner 66 is located to cross over the tabs 17 arranged between the first protection walls 41A as shown in FIG. 6. As a result, the opposite widthwise ends of the leading corner 66 are held in contact with the first protection walls 41A, but widthwise intermediate parts of the leading corner 66 cannot contact the tabs 17. Accordingly, even if the female housing 60 is inserted in an improper posture into the receptacle 12, the leading corner 66 of the female housing 60 does not contact the leading ends of the tabs 17 and the tab protection 41 protects the tabs 17. The front surface of the female housing 60 could be inclined in the width direction with respect to the proper connection surface and/or displaced in height direction. However, this front surface will contact the opening edge of the receptacle 12 and the female housing 60 will not enter the receptacle 12. Therefore, it is sufficient to consider only the above case where the front surface of the female housing 60 is inclined in forward and backward directions with respect to the proper connection surface as a mode in which the female housing 60 is inserted in an improper posture into the receptacle 12.

If the female housing 60 is inserted in an improper posture into the receptacle 12 from front, the corner 66 of the female housing 60 contacts the projecting end of the tab protection 41 to avoid contact with the tabs 17 of the male terminal fittings 15. Therefore, the tabs 17 will not be deformed plastically or otherwise damaged.

The projecting end of the protection wall 41 is more forward than the leading ends of the tabs 17 when the moving plate 40 is at the initial position IP. Thus, the corner 66 of the improperly oriented female housing 60 cannot contact the tabs 17.

Further, if the female housing 60 is inserted in an improper posture into the receptacle 12, the corner 66 of the female housing 60 contacts the first protection walls 41A while crossing over the tabs 17 of the male terminal fittings 15 arranged between the first protection walls 41A. Therefore, the corner 66 of the female housing 60 will not contact the leading ends of the tabs 17 and damage (e. g. plastic deformation) of the tabs 17 is prevented more reliably.

Furthermore, the tab protection 41 is surrounds the groups 48 of positioning holes 47. Thus, the strength of the main body 42 is increased and plastic deformation of the main body 42 due to an external factor is prevented.

The invention is not limited to the above described and illustrated embodiment. For example, the following embodiments are also embraced by the technical scope of the present invention as defined by the claims.

Even if the projecting end of a part of the protection wall is retracted from the leading ends of the tab when the moving plate is at the initial position, enough protection can be given if the deformation of the tabs can be prevented by the other part of the protection wall.

The protection wall may be formed to intermittently or only partly surround the hole groups instead of continuously or fully surrounding them.

Protection walls may be provided individually for the respective positioning holes or, conversely the protection wall may be formed to correspond to all the positioning holes.

The protection wall may be comprised of either the first protection walls or the second protection walls.

The projecting ends of the protection wall and the leading ends of the tabs may be substantially aligned at the same position.

The present invention is also applicable to connectors that are not lever-type connectors.

What is claimed is:

1. A connector, comprising:

a housing with a receptacle for receiving a mating housing, and at least one moving plate for positioning at least one terminal fitting in the receptacle, wherein:

the moving plate has a main body with at least one positioning hole, the moving plate being movable from an initial position to an end position at a back side of the receptacle as the mating housing is fit in the receptacle, a leading end of the male terminal fitting projecting through the positioning hole and from a front surface of the main body when the moving plate is at the initial position, and at least one protection wall projecting from the front surface of the main body and configured for protecting a leading end of the terminal fitting when the moving plate is at the initial position, wherein the protection wall is permitted to escape into a recess of the mating housing, wherein a projecting end of the protection wall is aligned with or forward of the leading end of the terminal fitting at the initial position.

2. The connector of claim 1, wherein the protection wall includes at least two opposite walls arranged to extend substantially along two opposite sides of the main body.

3. The connector of claim 2, wherein a corner of the mating housing contacts the opposite walls while crossing over the terminal fittings arranged between the opposite walls if the mating housing is inserted into the receptacle in an improper posture while the moving plate is at the initial position.

4. The connector of claim 1, wherein the protection wall surrounds a group of the positioning holes.

5. The connector of claim 1, further comprising a movable member that is operable for assisting connection of the housing with the mating housing.

6. The connector of claim 5, wherein the moving plate is displaced by operation of the movable member.

7. A connector assembly comprising the connector of claim 1 and a mating connector with a mating housing insertable into the receptacle.

8. The connector assembly of claim 7, wherein the protection wall has two opposite walls extending along opposite sides of the main body so that a corner of the mating housing contacts the opposite walls while crossing over the terminal fitting between the opposite walls if the mating housing is inserted into the receptacle in an improper posture while the moving plate is at the initial position.

9. The connector assembly of claim 7, wherein a movable member is provided on one of the housing and the mating housing and is operable to perform or assist the connection of the housing with the mating housing.

* * * * *